US009304464B2

(12) United States Patent
Endo

(10) Patent No.: US 9,304,464 B2
(45) Date of Patent: Apr. 5, 2016

(54) IMAGE FORMING APPARATUS

(71) Applicant: CANON KABUSHIKI KAISHA, Tokyo (JP)

(72) Inventor: Hiroto Endo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/637,227

(22) Filed: Mar. 3, 2015

(65) Prior Publication Data

US 2015/0253711 A1 Sep. 10, 2015

(30) Foreign Application Priority Data

Mar. 5, 2014 (JP) ..... 2014-043095

(51) Int. Cl.

| | |
|---|---|
| ***G03G 15/00*** | (2006.01) |
| ***B65H 1/00*** | (2006.01) |
| ***G03G 15/23*** | (2006.01) |

(52) U.S. Cl.

CPC ..... *G03G 15/50* (2013.01); *B65H 1/00* (2013.01); *G03G 15/231* (2013.01); *G03G 15/6529* (2013.01); *G03G 15/6594* (2013.01); *G03G 2215/00599* (2013.01); *G03G 2215/00734* (2013.01)

(58) Field of Classification Search

CPC ..... G03G 15/50; G03G 15/6529; G03G 2215/00734

USPC ..... 399/45, 82, 389, 401

See application file for complete search history.

(56) References Cited

U.S. PATENT DOCUMENTS 8,503,922 B2 * 8/2013 Maeda et al. ..... 399/396

FOREIGN PATENT DOCUMENTS

| | | | |
|---|---|---|---|
| JP | 02-060776 | A | 3/1990 |
| JP | 2002-037540 | A | 2/2002 |
| JP | 2002-337417 | A | 11/2002 |
| JP | 2002-351158 | A | 12/2002 |

* cited by examiner

*Primary Examiner* — Hoang Ngo

(74) *Attorney, Agent, or Firm* — Canon USA, Inc. I.P. Division

(57) ABSTRACT

An image forming apparatus includes a detection unit, a determination unit, and a control unit. The detection unit detects a length of a conveyed recording medium. The determination unit determines the number of recording media conveyable in double-sided image formation, on the basis of a result of detection by the detection unit. The control unit controls, on the basis of a result of determination by the determination unit, the order in which image forming operations are performed when the double-sided image formation is performed on a plurality of recording media.

11 Claims, 5 Drawing Sheets

IMAGE FORMING APPARATUS

BACKGROUND OF THE INVENTION

1. Field of the Invention

The present invention relates to an image forming apparatus using an electrophotographic system and particularly relates to an image forming apparatus that can form an image on each side of a recording medium.

2. Description of the Related Art

The number of image forming apparatuses having a double-sided printing function has increased in recent years, and an increase in the productivity of double-sided printing has been desired. The increase in the productivity of double-sided printing requires appropriate control of the number of recording media conveyed in an image forming apparatus.

For example, Japanese Patent Laid-Open No. 2002-37540 discloses a method enabling designation of the number of recording media to be circulated in an image forming apparatus to perform double-sided printing in consideration of the size or type of the recording media designated by a user through a control panel. Such control over the number of recording media to be circulated enables efficient double-sided printing.

However, in this method, the number of recording media to be circulated in the double-sided printing is changed in accordance with settings made by the user. If there is a mistake in setting the size of recording media by the user or the number of recording media to be circulated, the recording media might collide with each other, and thus a paper jam might occur. In addition, such a mistake might cause a decrease in productivity, and thus a decrease in usability.

SUMMARY OF THE INVENTION

According to the present invention, an image forming apparatus enabled to perform double-sided image formation includes a detection unit, a determination unit, and a control unit. In the double-sided image formation, an image is formed on a first side of a recording medium, thereafter the recording medium is turned over, and then an image is formed on a second side of the recording medium. The detection unit detects a length of a conveyed recording medium. The determination unit determines the number of recording media conveyable in double-sided image formation, on the basis of a result of detection by the detection unit. The control unit controls, on the basis of a result of determination by the determination unit, the order in which image forming operations are performed when the double-sided image formation is performed on a plurality of recording media.

Further features of the present invention will become apparent from the following description of an exemplary embodiment with reference to the attached drawings.

DESCRIPTION OF THE EMBODIMENTS

Hereinafter, an embodiment of the present invention will be described by using the drawings. The following embodiment does not limit the invention according to the scope of the claims, and not all of combinations of characteristics described in the embodiment are essential for the invention.

First Embodiment

Figure 1:
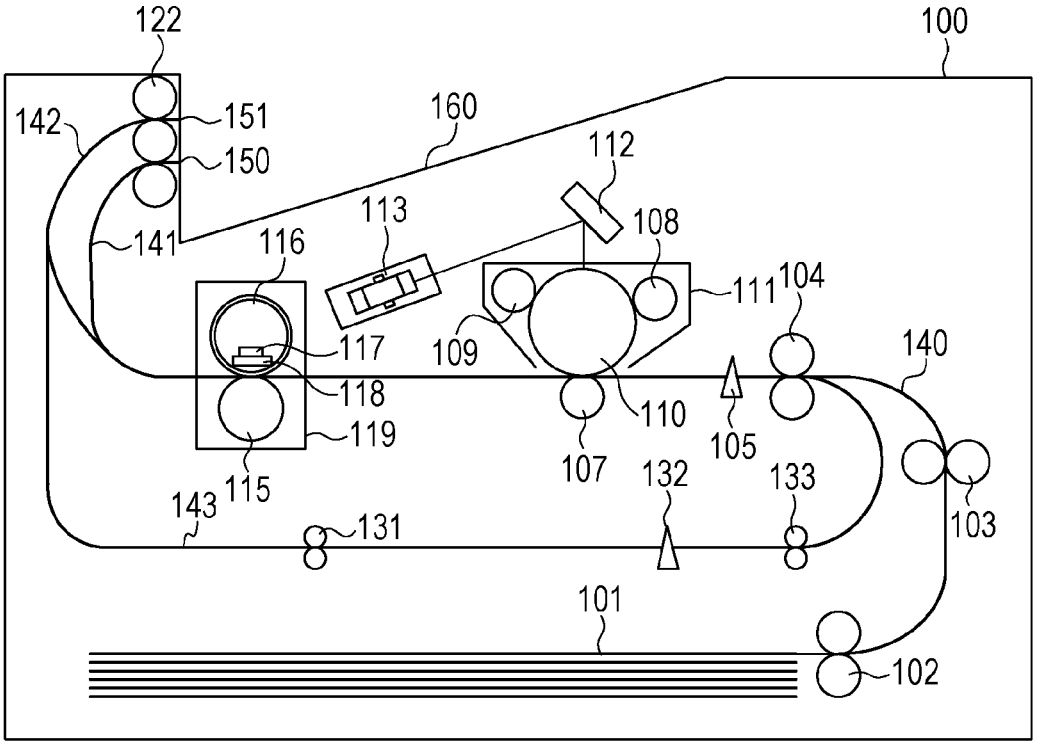
FIG. 1 is a schematic configuration diagram of an image forming apparatus.

FIG. 1 is a schematic configuration diagram of an image forming apparatus in the embodiment. An image forming operation will first be described. A photoconductor drum 110 is formed of amorphous silicon and the like and is driven to rotate clockwise in FIG. 1 at a predetermined circumferential velocity (process speed). The photoconductor drum 110 is evenly charged by a charge roller 109 to have a predetermined polarity and a potential on a circumferential surface. A scanner unit 113 performs exposure of the charged photoconductor drum 110.

Specifically, a laser beam emitted in accordance with image data inputted from an image reading device (not shown), an external computer, or another device is reflected by a laser-beam reflection mirror 112 to perform the exposure, and an electrostatic latent image is formed. The electrostatic latent image thus formed is developed by using a developing roller 108 into a toner image.

Next, an operation of conveying recording media will be described. Each of recording media stacked in a feeding cassette 101 is fed to a conveyance path 140 by feed rollers 102. The recording medium thus fed is conveyed by conveyance rollers 103 and registration rollers 104, and the leading edge of the recording medium is detected by a registration sensor 105. In response to the detection of the recording medium by the registration sensor 105, an image forming operation is performed. The recording medium is conveyed to a first transfer portion including a nip portion formed by the photoconductor drum 110 and a transfer roller 107 to be placed in the first transfer portion in synchronization with the image forming operation. A transfer bias having a polarity opposite from the polarity of the toner image formed on the photoconductor drum 110 is supplied to the transfer roller 107 in the first transfer portion, and thereby the toner image on the photoconductor drum 110 is transferred onto the recording medium. The recording medium having the toner image transferred thereon is conveyed to a fixing unit 119. The toner image yet to be fixed on the recording medium is thermally fixed on the recording medium by using a heater 118, a fixing film 116, and a pressure roller 115 of the fixing unit 119. The above describes the image forming operation performed on a first side of the recording medium.

In a case where the recording medium having the toner image fixed thereon is to be discharged from the image forming apparatus, the recording medium is conveyed to a face-down (FD) discharge conveyance path 141 and then is discharged to an FD tray 160 by using discharge rollers 122. In a case where the image forming operation is to be performed also on a second side of the recording medium in double-sided printing, the recording medium is conveyed to a double-sided-turnover conveyance path 142 to be turned over and then is conveyed by using the discharge rollers 122 to a position where the recording medium can be conveyed to a double-sided conveyance path 143. An FD flapper (not shown) is arranged at a portion where the FD discharge conveyance path 141 and the double-sided-turnover conveyance path 142 are separated from each other, thus enabling switching between a direction of conveying the recording medium to the FD discharge conveyance path 141 and a direction to the double-sided-turnover conveyance path 142.

The discharge rollers 122 have a triple-roller structure, and the three rollers are driven by a single driving source. The three rollers form two nip portions and are designed to be driven in directions in which a recording medium held in one of the nip portions is discharged to the outside of the image forming apparatus and in which a recording medium held in the other nip portion is drawn into the inside. Specifically, when the discharge rollers 122 are rotated in a forward direction, a discharge port 150 of the FD discharge conveyance path 141 is driven in the direction in which the recording medium is discharged, and at the same time a discharge port 151 of the double-sided-turnover conveyance path 142 is driven in the direction in which the recording medium is drawn into the inside. When the discharge rollers 122 are rotated in a reverse direction, the recording medium is conveyed in a direction opposite from a corresponding one of the directions in the forward rotation. Note that the discharge rollers 122 are not limited to the triple rollers. Rollers that are independently driven for discharging a recording medium and drawing a recording medium into a double-sided-turnover conveyance path may be arranged as the discharge rollers 122.

The recording medium turned over for double-sided printing is returned to the conveyance path 140 through double-sided conveyance roller 131, a double-side sensor 132, and re-feed rollers 133 and undergoes the image forming operation on the second side. Since how the image forming operation is specifically performed is the same as the image forming operation performed on the first side described above, a detailed explanation thereof is omitted. Turning on and off of driving of the double-sided conveyance roller 131 are switched by using a double-side driving clutch 126 (not shown). By turning off the driving of double-sided conveyance roller 131 in a case where the double-sided conveyance roller 131 carry the recording medium, at least one recording medium having a length between Lp1 and Lp2 inclusive can be made to wait in the double-sided conveyance path 143. A preceding recording medium conveyed by using the double-sided conveyance roller 131 is made to wait, and a recording medium to be subsequently conveyed is fed from the feeding cassette 101. An image can thereby be formed on the first side of the subsequently conveyed recording medium. As described above, a plurality of recording media are conveyed in the image forming apparatus, and double-sided printing is performed in which an image is formed alternately on a preceding recording medium and a following recording medium. The productivity can be increased more than in a case where the double-sided printing is performed on recording media one by one.

Figure 2:
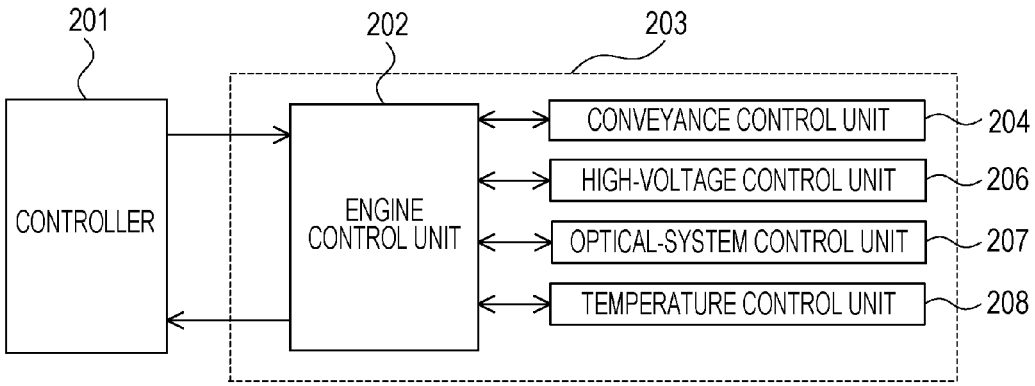
FIG. 2 is a control block diagram of the image forming apparatus.

FIG. 2 is a control block diagram of the image forming apparatus in the embodiment. A controller 201 develops image data received from an external device such as a host computer into bit data from which a printer can print an image, displays internal setting information of the image forming apparatus on a display device, and determines the order in which image forming operations are performed. An engine 203 has an one-chip microcomputer serving as an engine control unit 202 and having a read only memory (ROM) and a random access memory (RAM) that are incorporated in the microcomputer. The engine control unit 202 transmits and receives image data and the status of the engine 203 through a communication line connected to the controller 201 and controls components of the engine 203 in accordance with a printing instruction from the controller 201.

A conveyance control unit 204 controls the start and stop of the rotation of a driving system such as the feed rollers 102 or the conveyance rollers 103 in accordance with instructions from the engine control unit 202 and thereby controls conveyance of recording media. A high-voltage control unit 206 controls output of a high voltage (hundreds to thousands of volts) for charging the charged photoconductor drum 110, developing the latent image, and transferring the toner image, in accordance with instructions from the engine control unit 202. An optical-system control unit 207 controls driving and stopping of a scanning motor installed in the scanner unit 113, blinking of the laser beam, and the like in accordance with instructions from the engine control unit 202. A temperature control unit 208 controls the temperature of the heater 118 so that the temperature can be a target temperature designated by the engine control unit 202.

Figure 3:
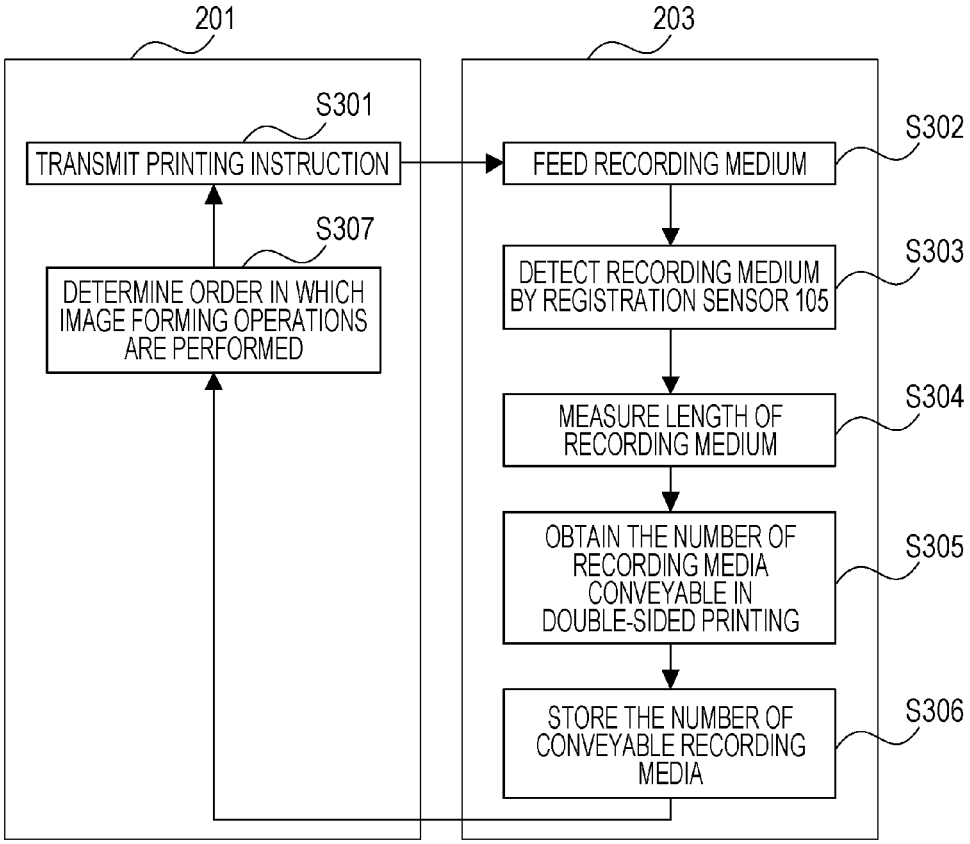
FIG. 3 is a flowchart illustrating how to determine the order of conveying recording media in double-sided printing.

FIG. 3 is a flowchart illustrating how to determine the order of conveying recording media in double-sided printing. When the double-sided printing is performed, the controller 201 first transmits a printing instruction to the engine 203 in S301. The printing instruction may be transmitted by using serial communication through a communication line or transmitted as an electric signal by using hardware. Upon receipt of the printing instruction, the engine control unit 202 causes one of recording media to be fed from the feeding cassette 101 in S302. In response to the feeding of the recording medium, it is determined whether the registration sensor 105 detects the leading edge of the recording medium in S303.

After the registration sensor 105 detects the leading edge of the recording medium, a period of time from the detection of the leading edge of the recording medium by the registration sensor 105 to detection of the trailing edge of the recording medium is measured in S304. The length of the recording medium in the conveyance direction is obtained on the basis of the measured period of time and the conveyance speed of the recording medium, the length being used as a result of detection. Note that although measuring the period of time from the detection of the leading edge of the recording medium by the registration sensor 105 to the detection of the trailing edge of the recording medium has herein been described as an example, the detection is not limited thereto. As long as information can be used for determining the number of recording media to be conveyed in the double-sided printing, the length of the recording medium in a direction orthogonal to the conveyance direction may be detected to be used as the information. Alternatively, the lengths of the recording medium in the conveyance direction and in the direction orthogonal to the conveyance direction may be detected. Although the registration sensor 105 has herein been described as a detection unit, another sensor or the like may be used as long as the sensor can detect information for obtaining the length of the recording medium.

After obtaining the length of the recording medium in the conveyance direction, the engine control unit 202 determines the number of recording media conveyable in the double-sided printing in S305, the number being used as a result of determination. A specific method for calculating the number of conveyable recording media will be described later. After the number of recording media is obtained, information regarding the number of recording media is stored in a volatile RAM or a nonvolatile memory serving as a storage unit in S306. In S307, the number of recording media conveyable in the double-sided printing is transmitted to the controller 201. The controller 201 determines the order in which image forming operations are performed, on the basis of the received number of recording media. A specific method for determining the order in which image forming operations are performed will be described later. Again in S301, the controller 201 transmits a printing instruction to the engine 203 on the basis of the determined order in which image forming operations are performed.

Figure 4:
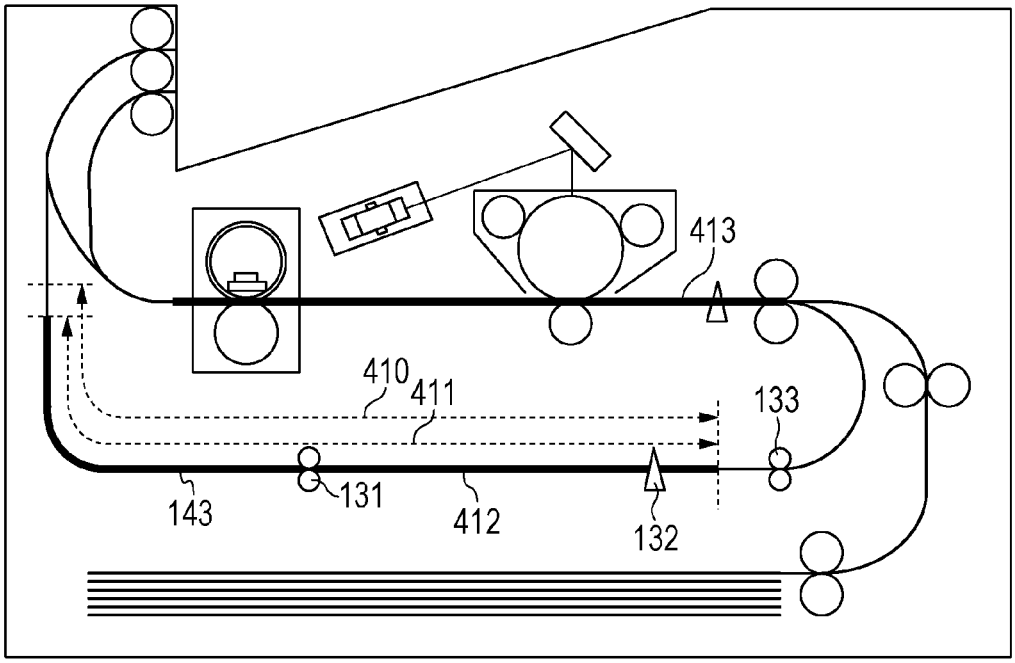
FIG. 4 is a diagram illustrating a state in which the number of recording media is determined in the double-sided printing.

FIG. 4 is a diagram illustrating a state in which the number of recording media is determined in the double-sided printing. Reference numeral 410 denotes a length within which a recording medium can wait in the double-sided conveyance path (hereinafter, referred to as a wait length). The wait length 410 is determined as a distance from a position a predetermined distance away from the double-side sensor 132 to a position where a preceding sheet 412 that has stopped in the double-sided conveyance path does not collide with a subsequently conveyed sheet 413 in the conveyance path.

A specific example will be described where the wait length 410 is Lr and where a length 411 of the preceding sheet 412 is Lpaper. If Lpaper is equal to or shorter than Lr, the length 411 of the preceding sheet 412 is equal to or shorter than the wait length 410. Thus, the preceding sheet 412 can be stopped within the length 410. Accordingly, the number of recording media to be conveyed in the double-sided printing is determined as two. In contrast, if Lpaper is longer than Lr, the length 411 of the preceding sheet 412 is longer than the wait length 410. Thus, the preceding sheet 412 is stopped beyond the length 410. Accordingly, the number of recording media to be conveyed in the double-sided printing is determined as one. More specifically, assume a case of Lr=297.0 mm. For example, if the length 411 of the preceding sheet 412 is 279.4 mm, the number of recording media to be conveyed in the double-sided printing is two. In contrast, if the length 411 of the preceding sheet 412 is 330.0 mm, the number of recording media to be conveyed in the double-sided printing is one.

Another example in which a plurality of recording media are made to wait in the double-sided conveyance path 143 will be described. The length of a first recording medium made to wait in the double-sided conveyance path 143 is Lpaper1, the length of an N-th recording medium is LpaperN, and a gap between the N-th recording medium waiting in the double-sided conveyance path 143 and an (N−1)th recording medium is LgapN. If Lpaper is longer than Lr, the recording medium waiting in the double-sided conveyance path 143 is stopped beyond the length 410. Accordingly, the number of recording media to be conveyed in the double-sided printing is determined as one. If Lpaper is equal to or shorter than Lr, the number of recording media waiting in the double-sided conveyance path 143 is obtained in accordance with the following Formula (1).

$$Lpapar_1 + \sum_{1}^{N} (Lpapre_{N+1} + Lgap_N) \leq Lr \tag{1}$$

By using a maximum value Nmax satisfying Formula (1), the number M of conveyed recording media in the double-sided printing can be obtained in accordance with M=Nmax+1. Specifically, in a case of Lr=450 mm, Lgap=30 mm, and Lpaper=210 mm, Nmax=2 holds true. Accordingly, the number M of conveyed recording media in the double-sided printing is 3 which is the result of 2+1. Incidentally, if margin is provided in consideration of a measurement error of recording media when the number of conveyed recording media M is obtained, conveyance can be controlled to further reduce paper jams.

Figure 5A:
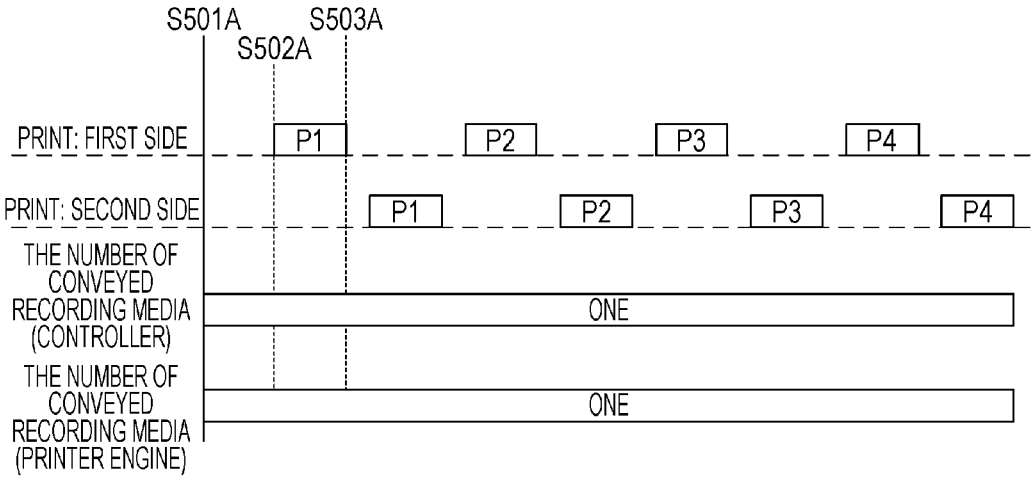
FIGS. 5A and 5B are timing charts illustrating control of the order in which image forming operations are performed, the control being performed according to the number of recording media to be conveyed in the double-sided printing.
Figure 5B:
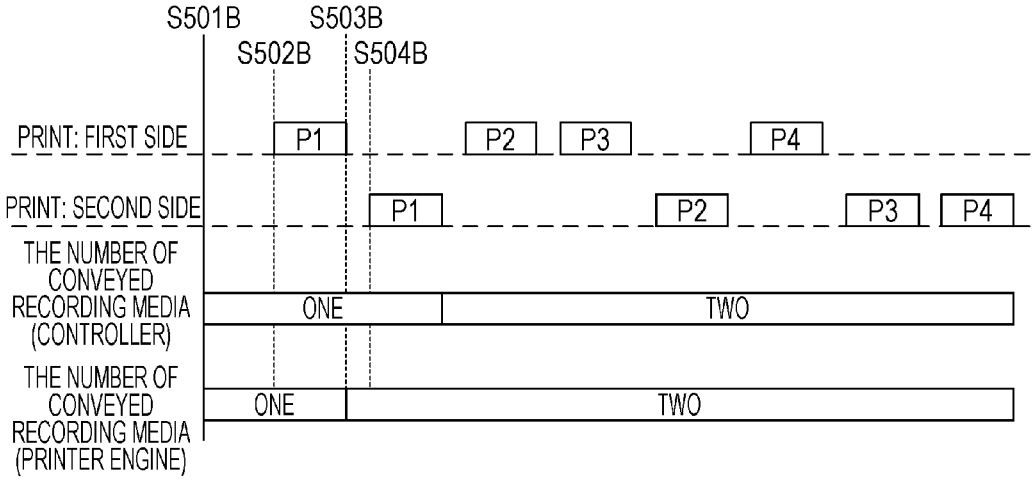

FIGS. 5A and 5B are timing charts illustrating control of the order in which image forming operations are performed, the control being performed according to the number of recording media to be conveyed in the double-sided printing. A case where a total of eight images are formed on each side of four recording media will be described by using the timing charts in FIGS. 5A and 5B. FIG. 5A illustrates image forming operations performed in a case where the number of recording media to be conveyed in the double-sided printing is one. FIG. 5B illustrates image forming operations in the double-sided printing performed in a case where the number of recording media to be conveyed in the double-sided printing is changed from one to two according to the length of the recording media in the conveyance direction.

FIG. 5A will first be described. If the number of recording media to be conveyed in the double-sided printing has not been determined in S501A, the controller 201 determines that one recording medium is to be conveyed and transmits a printing instruction. The engine control unit 202 having received the printing instruction starts forming an image on a first side of a first recording medium in S502A. After the registration sensor 105 detects the leading edge of the first recording medium, a period of time from detection of the leading edge of the first recording medium by the registration sensor 105 to detection of the trailing edge thereof is measured. Upon detection of the trailing edge in S503A, the length of the first recording medium in the conveyance direction is obtained. If it is determined that the obtained length of the first recording medium in the conveyance direction is longer than the wait length 410, the double-sided printing is continued without changing the number of recording media to be conveyed that is one. The first recording medium having undergone the image forming operation on the first side is conveyed to the double-sided conveyance path 143. The double-sided conveyance path 143 causes the first recording medium to be turned over, and the first recording medium undergoes the image forming operation on a second side thereof and is discharged to the outside. The same holds true for subsequently conveyed second, third, and fourth recording media. In FIG. 5A, the image forming operation is performed as described above, with one recording medium being conveyed in the double-sided printing.

Next, FIG. 5B will be described. Since the image forming operation performed on a first side of a first recording medium is the same as that in FIG. 5A, a description thereof is herein omitted. In FIG. 5B, if it is determined that the obtained length of the first recording medium in the conveyance direction is equal to or shorter than the wait length 410, the engine control unit 202 determines that the number of recording media to be conveyed in the double-sided printing is two. In S504B, the engine control unit 202 transmits to the controller 201 the number of recording media to be conveyed in the double-sided printing that is two. The controller 201 determines the order in which image forming operations are performed for remaining pages according to the received number of recording media to be conveyed.

The controller 201 first causes an image to be formed on a second side of the first recording medium. The controller 201 then causes an image to be formed on a first side of a second recording medium, causes the second recording medium to wait in the double-sided conveyance path 143, and causes an image to be formed on a first side of a third recording medium. After the image is formed on the first side of the third recording medium, the controller 201 causes the second recording medium waiting in the double-sided conveyance path 143 to be conveyed again and an image to be formed on a second side of the second recording medium. The controller 201 causes the third recording medium to wait in the double-sided conveyance path 143. After the image is formed on the second side of the second recording medium, the controller 201 subsequently causes an image to be formed on a first side of a fourth recording medium. When the image is formed on the first side of the fourth recording medium, the third recording medium waits in the double-sided conveyance path 143. After the image is formed on the first side of the fourth recording medium, the controller 201 subsequently causes an image to be formed on a second side of the third recording medium. The controller 201 then causes an image to be formed on a second side of the fourth recording medium, and the series of image forming operations are terminated. In FIG. 5B, the order in which image forming operations are performed is changed as described above depending on the number of recording media to be conveyed in the double-sided printing. The following describes how the productivity of an image forming apparatus capable of forming images, for example, at a speed of 35 pages per minute (ppm) for single-sided printing is changed as a result of changing the order in which image forming operations are performed as described above. If the number of recording media to be conveyed in the double-sided printing is one, the double-sided printing is performed at a speed of 16 images per minute (ipm). In contrast, if the number of recording media to be conveyed in the double-sided printing is two, the double-sided printing can be performed at a speed of 28 ipm. The productivity can be increased by 12 ipm by changing the number of recording media to be conveyed in the double-sided printing.

As described above, the number of recording media to be conveyed in the double-sided printing can be appropriately controlled according to the size of a recording medium detected in the image forming apparatus. More specifically, the number of recording media to be conveyed in the double-sided printing can be increased according to the length of the recording medium in the conveyance direction, and the double-sided printing can be performed in an appropriate order in which image forming operations are performed, according to the increased number of conveyed recording media. This makes it possible to reduce a decrease in productivity caused by an inappropriate order in which image forming operations are performed, thus reducing a decrease in usability.

Figure 6A:
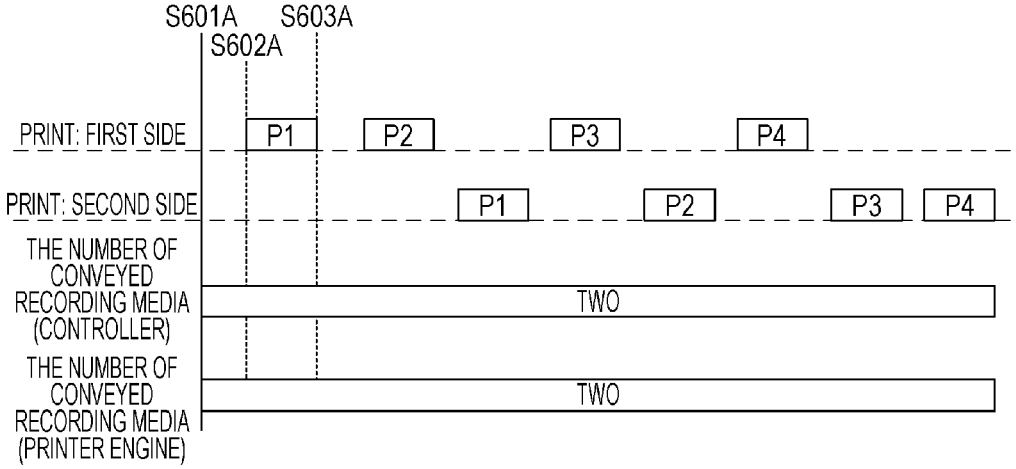
FIGS. 6A and 6B are timing charts illustrating control of the order in which image forming operations are performed, the control being performed according to the number of recording media to be conveyed in the double-sided printing.
Figure 6B:
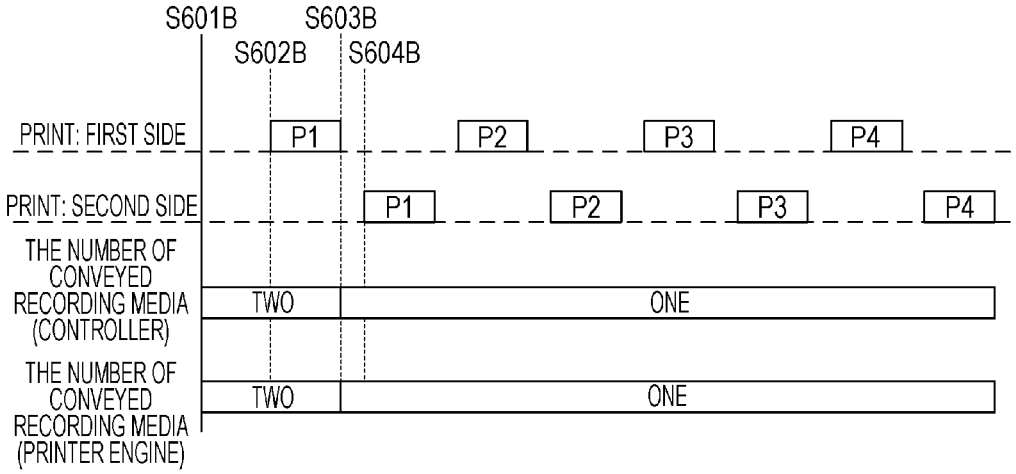

FIGS. 6A and 6B are timing charts illustrating control of the order in which image forming operations are performed, the control being performed according to the number of recording media to be conveyed in the double-sided printing. A case where a total of eight images are formed on each side of four recording media will be described by using the timing charts in FIGS. 6A and 6B. FIG. 6A illustrates image forming operations in the double-sided printing performed in a case where the number of recording media to be conveyed in the double-sided printing is two. FIG. 6B illustrates image forming operations in the double-sided printing performed in a case where the number of recording media to be conveyed in the double-sided printing is changed from two to one according to the length of the recording media in the conveyance direction.

FIG. 6A will first be described. If the number of recording media to be conveyed in the double-sided printing has not been determined in S601A, the controller 201 determines that two recording media are to be conveyed and transmits a printing instruction. The engine control unit 202 having received the printing instruction starts forming an image on a first side of a first recording medium in S602A. After the registration sensor 105 detects the leading edge of the first recording medium, a period of time from detection of the leading edge of the first recording medium by the registration sensor 105 to detection of the trailing edge thereof is measured. After the trailing edge is detected in S603A, the length of the first recording medium in the conveyance direction is obtained. If it is determined that the obtained length of the first recording medium in the conveyance direction is longer than the wait length 410, the double-sided printing is continued with two recording media being conveyed in this case. The first recording medium having undergone the image forming operation on the first side is conveyed to the double-sided conveyance path 143. With the first recording medium waiting in the double-sided conveyance path 143, an image is formed on a first side of a second recording medium. In this case, the first recording medium is longer than the wait length 410 and thus is stopped at a position where the first recording medium is to collide with the second recording medium. The collision of the first recording medium with the second recording medium might cause a paper jam.

Next, FIG. 6B will be described. Since the image forming operation performed on a first side of a first recording medium is the same as that in FIG. 6A, a description thereof is herein omitted. In FIG. 6B, if it is determined that the obtained length of the first recording medium is longer than the wait length 410, the engine control unit 202 determines that the number of recording media to be conveyed in the double-sided printing is one. In S604B, the engine control unit 202 transmits to the controller 201 the number of recording media to be conveyed in the double-sided printing that is one. The controller 201 determines the order in which image forming operations are performed for remaining pages according to the received number of recording media to be conveyed.

Before causing a second recording medium to be conveyed, the controller 201 first causes an image to be formed on a second side of the first recording medium. The first recording medium having undergone the image forming operation on the second side is discharged to the outside. The controller 201 then causes an image to be formed on a first side of the second recording medium. Before causing a third recording medium to be conveyed, the controller 201 causes an image to be formed on a second side of the second recording medium. The image forming operations are performed on the third recording medium and a fourth recording medium in the same manner. In FIG. 6B, the order in which image forming operations are performed is changed as described above depending on the number of recording media to be conveyed in the double-sided printing.

As described above, the number of recording media to be conveyed in the double-sided printing can be appropriately controlled according to the size of a recording medium detected in the image forming apparatus. More specifically, the number of recording media to be conveyed in the double-sided printing can be decreased according to the length of the recording medium in the conveyance direction, and the double-sided printing can be performed in an appropriate order in which image forming operations are performed, according to the decreased number of conveyed recording media. This makes it possible to reduce paper jams occurring due to collision between recording media, thus reducing a decrease in usability.

As described above, the number of recording media to be conveyed in the double-sided printing can be appropriately controlled according to the size of a recording medium detected in the image forming apparatus. The double-sided printing can thereby be performed in an appropriate order in which image forming operations are performed, according to the number of conveyed recording media. This makes it possible to reduce paper jams occurring due to collision between recording media and reduce a decrease in productivity caused by an inappropriate order in which image forming operations are performed, thus reducing a decrease in usability.

The image forming apparatus that forms black-and-white images has been described as an example of the present invention. However, the present invention is not limited thereto, and is applicable to a color-image forming apparatus using an intermediate transfer system, a direct transfer system, or the like.

According to the configuration of the present invention, an optimum number of recording media to be conveyed in an image forming apparatus is determined according to the size of the recording media to be conveyed in double-sided printing, and thereby a decrease in usability can be reduced.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2014-043095, filed Mar. 5, 2014, which is hereby incorporated by reference herein in its entirety.

What is claimed is:

1. An image forming apparatus enabled to perform double-sided image formation in which an image is formed on a first side of a recording medium, thereafter the recording medium is turned over, and then an image is formed on a second side of the recording medium, the image forming apparatus comprising:

a stacking unit in which a recording medium is stacked;

a detection unit that detects a length of the recording medium which has been conveyed from the stacking unit;

a determination unit that determines the number of recording media conveyable in the image forming apparatus in double-sided image formation, on a basis of a result of detection by the detection unit; and a control unit that controls, on a basis of a result of determination by the determination unit, an order in which image forming operations are performed when the double-sided image formation is performed on a plurality of recording media.

2. The image forming apparatus according to claim 1, wherein when a recording medium is conveyed from the stacking unit, the detection unit detects a length of the recording medium in a conveyance direction on a basis of a period from detection of a leading edge of the recording medium to detection of a trailing edge of the recording medium.

3. The image forming apparatus according to claim 1, further comprising:

a double-sided conveyance path that causes a recording medium to be turned over, wherein in a case where the determination unit determines that the length of the recording medium obtained from a result of detection by the detection unit is a length allowing the recording medium to wait in the double-sided conveyance path, the determination unit determines that the number of conveyable recording media is a plural number.

4. The image forming apparatus according to claim 3, wherein in a case where the determination unit determines that the number of conveyable recording media is a plural number, the control unit causes an image to be formed on a first side of a first recording medium, thereafter causes the first recording medium to wait in the double-sided conveyance path, and then causes an image to be formed on a first side of a second recording medium conveyed subsequently to the first recording medium.

5. The image forming apparatus according to claim 1, further comprising:

a double-sided conveyance path that causes a recording medium to be turned over, wherein in a case where the determination unit determines that the length of the recording medium obtained from a result of detection by the detection unit is a length not allowing the recording medium to wait in the double-sided conveyance path, the determination unit determines that the number of conveyable recording media is one.

6. The image forming apparatus according to claim 5, wherein in a case where the determination unit determines that the number of conveyable recording media is one, the control unit causes an image to be formed on a first side of a first recording medium, thereafter causes an image to be formed on a second side of the first recording medium, and then causes an image to be formed on a first side of a second recording medium conveyed subsequently to the first recording medium.

7. The image forming apparatus according to claim 1, wherein the control unit controls an order to form an image according to a length of a recording material detected by the detection unit, when performing double-sided image formation with respect to a recording material subsequent to the recording material of which a length is detected by the detection unit.

8. An image forming apparatus enabled to perform double-sided image formation in which an image is formed on a first side of a recording medium, thereafter the recording medium is turned over, and then an image is formed on a second side of the recording medium, the image forming apparatus comprising:

a stacking unit in which a recording medium is stacked;

a detection unit that detects a length of the recording medium which has been conveyed from the stacking unit; and a control unit that controls an order in which image forming operations are performed when double-sided image formation is performed, depending on the length of the first recording medium detected by the detection unit, such that an image is caused to be formed on a first side of the first recording medium, thereafter an image is caused to be formed on a second side of the first recording medium, and then an image is caused to be formed on a first side of a second recording medium conveyed subsequently to the first recording medium or such that an image is caused to be formed on the first side of the first recording medium and thereafter an image is caused to be formed on the first side of the second recording medium conveyed subsequently to the first recording medium.

9. The image forming apparatus according to claim 7, wherein when a recording medium is conveyed from the stacking unit, the detection unit detects a length of the recording medium in a conveyance direction on a basis of a period from detection of a leading edge of the recording medium to detection of a trailing edge of the recording medium.

10. The image forming apparatus according to claim 8, wherein the control unit causes an image to be formed on the first side of the first recording medium, thereafter causes the first recording medium to wait in a double-sided conveyance path, and then causes an image to be formed on the first side of the second recording medium conveyed subsequently to the first recording medium.

11. The image forming apparatus according to claim 8, wherein the control unit controls an order to form an image according to a length of a recording material detected by the detection unit, when performing double-sided image formation with respect to a recording material subsequent to the recording material of which a length is detected by the detection unit.

* * * * *